United States Patent [19]

Southwick et al.

[11] Patent Number: 4,561,268

[45] Date of Patent: Dec. 31, 1985

[54] WALL ADAPTER FOR TILT TYPE WASHER-EXTRACTOR MACHINE

[75] Inventors: Theron E. Southwick, Cazenovia; John W. Mitchell, Marcellus, both of N.Y.

[73] Assignee: G. A. Braun Inc., Syracuse, N.Y.

[21] Appl. No.: 626,882

[22] Filed: Jul. 2, 1984

[51] Int. Cl.[4] ..... D06F 39/00

[52] U.S. Cl. ..... 68/210

[58] Field of Search ..... 68/210; 414/13, 217; 193/34

[56] References Cited

FOREIGN PATENT DOCUMENTS 2522116 11/1976 Fed. Rep. of Germany ..... 68/210

*Primary Examiner*—Philip R. Coe

*Attorney, Agent, or Firm*—Bruns and Wall

[57] ABSTRACT

A wall adapter that can be incorporated in a wall that separates a soiled laundry room and a clean laundry room. The adapter is constructed in such a manner that it coacts with the tilting action of a tilt type washer-extractor machine whereby the latter can be utilized in a hospital laundry.

9 Claims, 7 Drawing Figures

WALL ADAPTER FOR TILT TYPE WASHER-EXTRACTOR MACHINE

BACKGROUND OF THE INVENTION

This invention relates generally to institutional laundry equipment, and has particular reference to a novel wall adapter that permits clean room use of a tilt type washer-extractor machine.

In many institutions, and in hospitals in particular, the laundry area is divided into a laundry receiving or soiled laundry room and a clean laundry room. These rooms are separated by a common wall in which a washer-extractor machine is incorporated, the machine having a loading door in the soiled room and an unloading door in the clean room whereby cross infection is prevented insofar as possible. This kind of prior art laundry arrangement is shown in U.S. Pat. Nos. 3,577,752 and 3,597,943, owned by the assignee of the present invention, and also in U.S. Pat. No. 3,318,122.

More recently, tilt type washer-extractor machines have been developed in which the wash cylinder is designed to be moved into a rearwardly tilted position for loading, into a horizontal position for washing and extracting, and into a forwardly tilted position for unloading. These machines have a number of advantages, particularly with respect to the ease of loading and unloading. However, because of the tilting action of the cylinder and the fact that there is only one access door, the machines have not heretofore been used in hospitals even though they have been well accepted for industrial applications. There exists, therefore, a need for a means to enable the advantageous tilt type machine to be used in hospital laundry areas where there are separate soiled laundry and clean laundry rooms.

SUMMARY OF THE INVENTION

The present invention is directed toward providing a novel wall adapter that can be incorporated in a wall which separates a soiled room and a clean room and is constructed in such a manner that it coacts with the tilting action of a tilt type washer-extractor machine whereby the latter can be utilized in a hospital laundry. The wall adapter is an alcove-like structure having an open front, side walls and an obliquely disposed back wall in which there is a normally closed opening. The adapter is incorporated in the wall separating the soiled and clean rooms so that its own wall structure projects into the soiled room and its front opens into the clean room.

The tilt type washer-extractor machine is located in the soiled room close to but spaced from the adapter back wall so that the machine can be conveniently loaded when in its rearwardly tilted position. However, when the machine is tilted forwardly into its unloading position, it moves into sealed engagement with the obliquely disposed adapter back wall. The opening in the adapter back wall is in registry with the access door of the washer-extractor machine and after the latter has moved into engagement with the wall a roll door that normally closes the wall opening is automatically opened. Thereafter, the machine access door is opened through the wall opening permitting the clean laundry to be unloaded into the clean room.

DESCRIPTION OF THE PREFERRED EMBODIMENT

Figure 1:
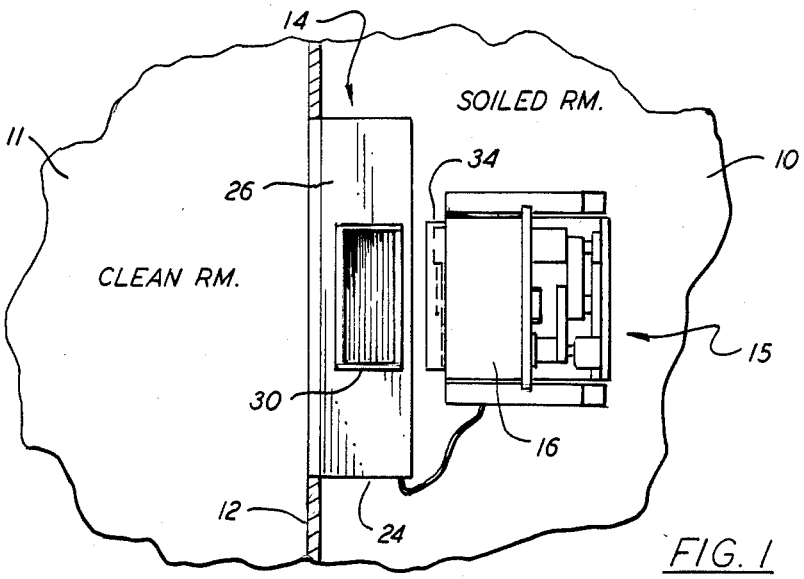
FIG. 1 is a diminutive, fragmentary top plan view of a typical hospital laundry area showing the wall adapter of the invention incorporated therein and a tilt type washer-extractor machine positioned in the soiled laundry room for coaction with the adapter.

Having reference now to the drawings, and with particular reference to FIG. 1, there is shown a typical hospital laundry area in which there is a laundry receiving or soiled laundry room 10 and a clean laundry room 11, the two rooms being separated by a wall 12. In the prior art, as is shown in FIG. 1 of Starr et al U.S. Pat. No. 3,318,122, supra, a stationary washing machine was built into the separating wall, the machine having a loading door in the soiled room and an unloading door in the clean room. In accordance with the invention, a wall adapter generally indicated at 14 is built into the separating wall 12 so that a tilt type washer-extractor machine having a single access door can be utilized, such a machine being generally indicated at 15.

Figure 2:
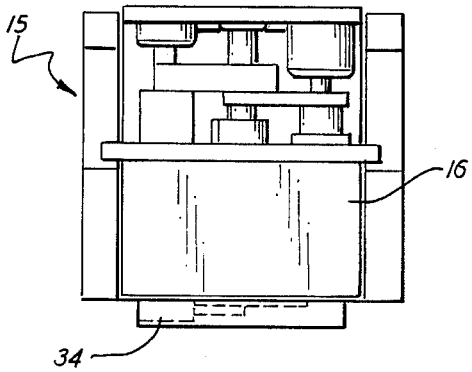
FIG. 2 is a top plan view of the washer-extractor machine.

The washer-extractor machine shown in the drawings is a commercially available machine and is not per se a part of the present invention. The machine 15 includes a cylinder 16 that is pivotally connected at 17, FIG. 4, to a base 18 that is rigidly secured to the soiled room floor. The cylinder can be pivoted or tilted by hydraulic cylinders, one of which is shown at 20 in FIG. 4, between three basic positions. These are the rearwardly tilted loading position shown in FIG. 5 and in phantom lines in FIG. 4, the horizontal operating position shown in FIGS. 1–3, and the forwardly tilted unloading position shown in FIGS. 4 and 6. On its front side, machine 15 is provided with an access door 21 that has an automatic opening and closing mechanism 22.

Figure 4:
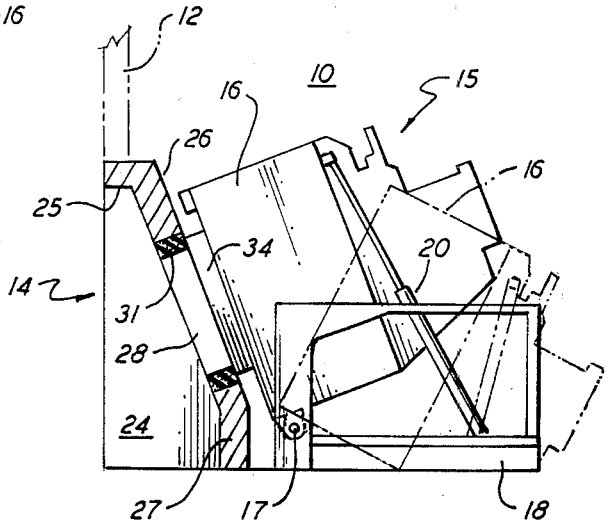
FIG. 4 is a side elevation of the machine shown tilted forwardly into engagement with the adapter, the latter being shown in section.

The wall adapter 14 is comprised of a pair of vertical side walls 24, a narrow, horizontal top wall 25 and an obliquely disposed back wall 26. The back wall 26 is connected at its lower edge to a short, vertical wall section 27. As best shown in FIGS. 4 and 6, the adapter 14 is open on its front side and the adapter is incorporated in the separating wall 12 so that this side faces or opens into the clean room 11. As indicated in FIGS. 1 and 4–6, the front edges of the adapter side and top walls are connected to the separating wall 12, the connection being such that a sealed joint is obtained between the wall 12 and adapter.

Figure 3:
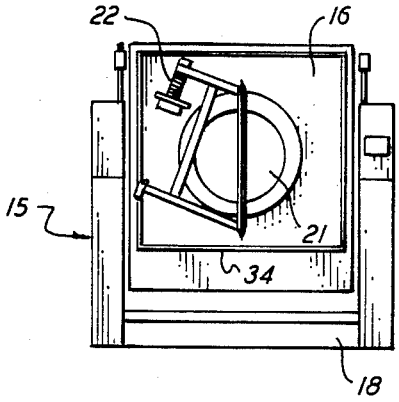
FIG. 3 is a front elevation of the machine.
Figure 5:
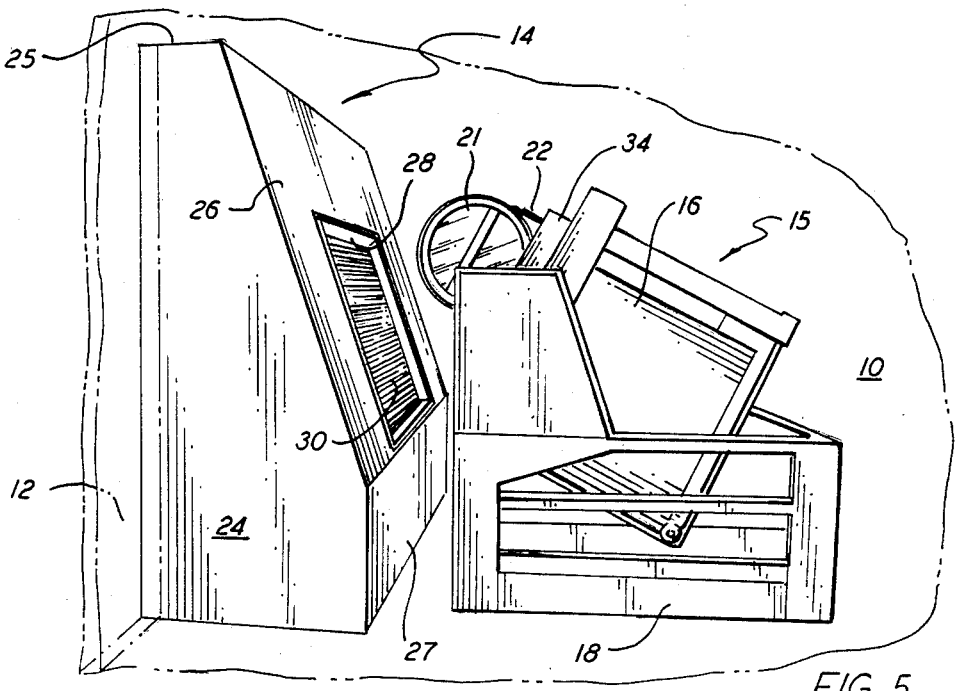
FIG. 5 is an enlarged perspective view of the machine and adapter looking from the soiled room side of the laundry area.
Figure 6:
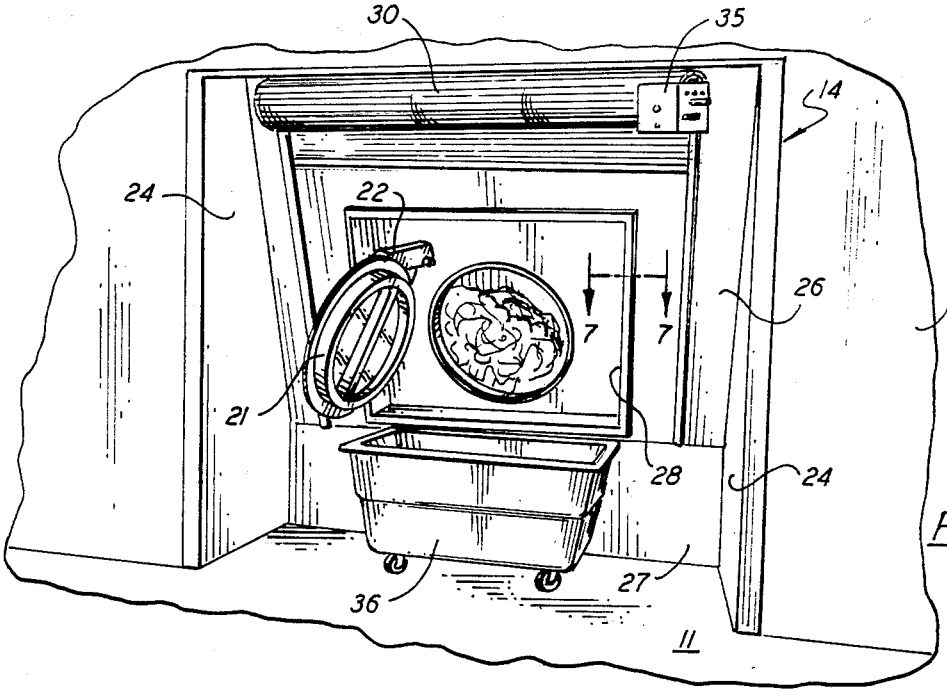
FIG. 6 is an enlarged perspective view of the adapter and machine looking from the clean room side of the laundry area.
Figure 7:
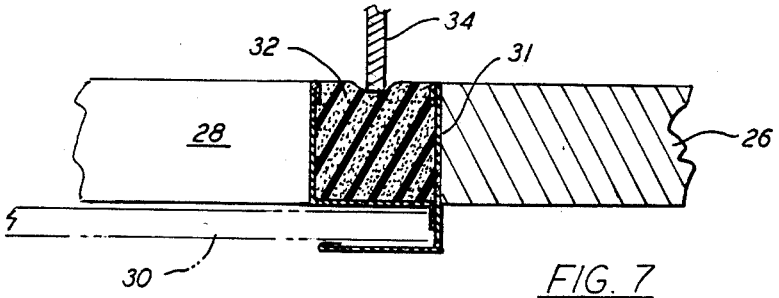
FIG. 7 is a greatly enlarged sectional view taken on line 7—7 of FIG. 6.

The obliquely disposed back wall 26 of the adapter is provided with a rectangular opening 28, and this opening is normally closed by a horizontally slatted roll door 30, FIGS. 1, 5 and 6. The opening 28 is surrounded by a continuous channel 31, FIG. 7, that is occupied by resilient gasket material 32. The washer-extractor machine 15 is fitted with an outwardly projecting rectangular flange 34, FIGS. 1–5 and 7 that surrounds the machine access door 21 as best shown in FIG. 3. The flange 34 is dimensioned so that it registers with the channel 31 whereby the outer edge of the flange is pressed into sealing engagement with the resilient gasket material 32, FIGS. 4 and 7, when the machine is in its forwardly tilted unloading position.

In operation, the washer-extractor machine is initially in its rearwardly tilted loading position as shown in FIG. 5 and in phantom lines in FIG. 4. The access door 21 of the machine is open and the access opening is disposed so that the machine can be conveniently loaded from above by sling or chute. During loading, the machine cylinder 16 is rotating and a water spray is directed into it to compact the load. When the loading has been completed, the access door is automatically closed and the machine is moved into its horizontal operating position in which position the washing and extracting of the load occurs. All of these operations are automatic and are under the control of a microprocessor (not shown) that forms a part of the machine.

Upon completion of the washing and extracting, the space between the machine and adapter is scanned by a known type optical sensor (not shown) and if the space is clear the machine is automatically moved into its forwardly tilted unloading position, FIG. 4, at which time the machine flange 34 moves into sealing engagement with the gasket material 32 on the obliquely disposed back wall 26 of the adapter. After the machine has been moved to its unloading position, the roll door 30 is moved out of the adapter wall opening 28 by suitable means such as an electric motor 35, FIG. 6. The opening of the adapter wall opening 28 signals the access door 21 to swing open, the door being powered by a commercially available rotary actuator 22, FIG. 3. In this connection, it is important to note that the wall opening 28 is in registry with the access door 21 of the machine when the latter is tilted into its unloading position and is dimensioned so that the machine door can swing freely through the wall opening to expose the interior of the machine to the clean room. At this time the machine interior is in sealed communication with the clean room, and and clean laundry in the machine can be unloaded into a cart 36 as shown in FIG. 6 or onto a conveyor (not shown).

After the machine has been unloaded, the machine access 21 receives a signal to swing shut after which the roll door 30 is automatically lowered to close the adapter wall opening 28. When the wall opening is completely closed, the machine is moved back from the adapter, through its horizontal position and into its rearwardly tilted loading position. The machine access door 21 is then swung open and the machine is ready for overhead loading as before.

From the foregoing description it will be apparent that the invention disclosed herein provides a novel and very advantageous wall adapter that permits clean room use of a tilt type washer-extractor machine. As will be understood by those familiar with the art, the invention may be embodied in other specific forms without departing from the spirit or essential characteristics thereof.

We claim:

1. For use with an industrial washer-extractor machine of the tilt type; the machine having but a single access door and being movable between a rearwardly tilted position for loading, a horizontal operating position, and a forwardly tilted position for unloading; an adapter for permitting clean room use of said tilt type machine, the adapter being arranged to be incorporated in a wall separating a soiled room and a clean room, the adapter projecting into the soiled room and including an obliquely disposed wall having an opening therein, a normally closed door for the opening, the last-named door being mounted on the obliquely disposed adapter wall, the tilt type machine being positioned in the soiled room and being engageable with the obliquely disposed adapter wall when the machine is moved into its forwardly tilted position, the machine engaging the wall in the area surrounding its opening, the wall opening being opposite the access door of the machine and being dimensioned so that the access door can be opened thru it after the normally closed door for the wall opening has been opened, whereby the machine can be unloaded thru the wall opening into the clean room.

2. An adapter as defined in claim 1 together with means surrounding the opening in the obliquely disposed adapter wall to form a seal between the wall and the machine when the latter is tilted into engagement with the wall.

3. An adapter as defined in claim 1 together with means on the adapter responsive to the engagement of the machine with the obliquely disposed adapter wall to open the door for the wall opening.

4. In combination with an industrial washer-extractor machine of the tilt type; a single access door mounted on the front of the machine, the machine being movable between a rearwardly tilted position for loading, a horizontal position for washing and extracting, and a forwardly tilted position for unloading; the improvement which comprises: an adapter for permitting clean room use of said tilt type machine, the adapter being arranged to be incorporated in a wall separating a soiled room and a clean room, the adapter projecting into the soiled room and including an obliquely disposed wall having an opening therein, a normally closed door in said wall opening, the tilt type machine being positioned in the soiled room adjacent the adapter and being engageable with the obliquely disposed adapter wall when the machine is moved into its forwardly tilted position, coacting means on the obliquely disposed adapter wall and the machine to provide a seal therebetween when the machine is moved into its forwardly tilted position, means on the adapter operable to open the normally closed door in the wall opening when the machine has been moved into its forwardly tilted position, the wall opening being opposite the access door of the machine and being dimensioned so that the access door can be opened thru it after the normally closed wall opening door has been opened, whereby the machine can be unloaded thru the wall opening into the clean room.

5. An adapter as defined by claim 4 wherein the coacting sealing means consists of resilient material surrounding the opening in the obliquely disposed adapter wall and an outwardly projecting flange on the machine, the flange surrounding the machine access door and being moved into engagement with the resilient material when the machine is moved into its forwardly tilted position.

6. An adapter as defined in claim 4 together with means on the adapter responsive to the engagement of the machine with the obliquely disposed adapter wall to open the normally closed wall opening door.

7. In combination with an industrial washer-extractor machine of the tilt type; the machine having but a single access door and being movable between a rearwardly tilted position for loading, a horizontal position for washing and extracting, and a forwardly tilted position for unloading; the improvement which comprises: an adapter for permitting clean room use of said tilt type machine, the adapter being arranged to be incorporated in a wall separating a soiled room and a clean room, the adapter including an obliquely disposed wall that extends into the soiled room, the tilt type machine being positioned in the soiled room adjacent to but normally spaced from the obliquely disposed adapter wall, the obliquely disposed wall being substantially parallel to the front wall of the machine when the latter is tilted forwardly into its unloading position, the obliquely disposed wall having an opening therein, a normally closed door in said wall opening, sealing means in the adapter surrounding the wall opening, the machine having an outwardly projecting flange member that engages the adapter sealing means to form a seal between the machine and the adapter when the machine is moved into its forwardly tilted position, means on the adapter responsive to the movement of the machine into its forwardly tilted position to open the normally closed door in the wall opening, the wall opening being opposite the access door of the machine and being dimensioned so that the access door can be opened thru it after the normally closed wall opening door has been opened, whereby the machine can be unloaded thru the wall opening into the clean room.

8. An adapter as defined in claim 7 wherein the adapter forms an alcove opening out of the clean room.

9. An adapter as defined in claim 7 wherein the normally closed door in the adapter wall opening is a roll door.

* * * * *